United States Patent [19]

Gloeckler

[11] Patent Number: 4,476,696

[45] Date of Patent: Oct. 16, 1984

[54] HOME KNITTING MACHINE

[75] Inventor: Alfred Gloeckler, Riedisheim, France

[73] Assignee: Superba S.A., Mulhous, France

[21] Appl. No.: 27,375

[22] Filed: Apr. 5, 1979

[30] Foreign Application Priority Data

Apr. 27, 1978 [FR] France ..... 78 12587

[51] Int. Cl.[3] ..... D04B 7/00; D04B 15/66

[52] U.S. Cl. ..... 66/75.2

[58] Field of Search ..... 66/75.2, 218, 233, 231

[56] References Cited

U.S. PATENT DOCUMENTS

| | | | |
|---|---|---|---|
| 3,953,988 | 3/1976 | Gloekler | 66/75.2 |
| 4,078,401 | 3/1978 | Kamikura et al. | 60/232 |
| 4,079,601 | 3/1978 | Kamikura et al. | 66/232 |
| 4,085,597 | 4/1978 | Kamikura et al. | 66/232 |
| 4,100,768 | 7/1978 | Kamikura et al. | 66/232 X |
| 4,105,157 | 8/1978 | Kagaya | 66/232 |

*Primary Examiner*—Ronald Feldbaum
*Attorney, Agent, or Firm*—Jones, Thomas & Askew

[57] ABSTRACT

This invention concerns a home knitting machine comprising at least one straight needle bed member provided with grooves slidably receiving the knitting needles, a carriage which is movable on the needle bed member and which is provide with selection units and cam tracks for actuating and displacing the needles of the needle bed member, a programming installation comprising reading means which are electrically connected to the selection units and which are relatively movable with respect to a program card, means for relatively displacing, from one row to the next, the reading means with respect to the program card, mechanical means for connecting the programming installation to the carriage for successive reading of the rows of the program card by the reading means in synchronism with the movement of the carriage, this machine being characterized in that the means for relatively displacing from one row to the next the reading means relative to the program card comprise means for adjusting the pitch of the scanned rows of the card.

13 Claims, 8 Drawing Figures

Fig : 1
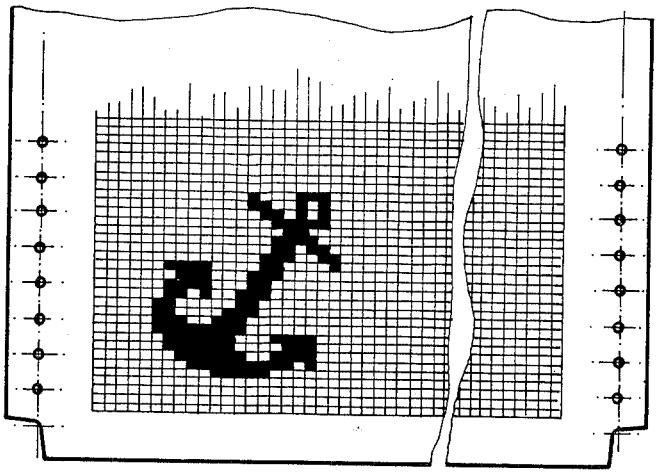
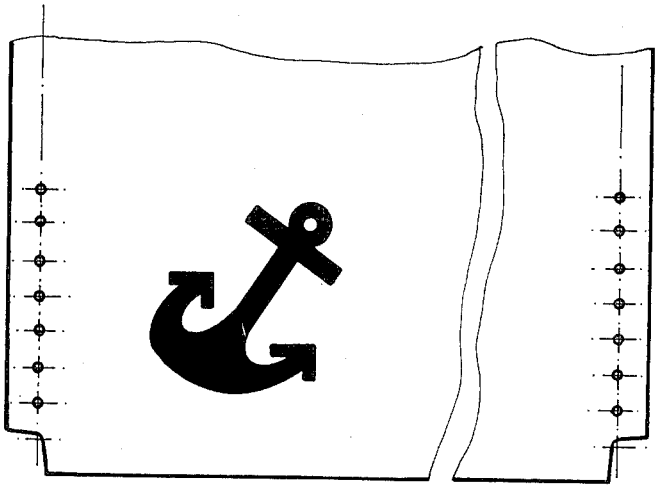
Fig : 2

13
14
15
15'
16
17
18
19
19'
19''
19'''
20
21
22
23
24
25
26
27
28
29
30
31
38

HOME KNITTING MACHINE

The present invention concerns a selection box for a home knitting machine having one or two straight needle bed members in which are formed channels for slidably receiving needles. The needles are actuated by cams carried by a knitting carriage which is moved with a reciprocating translatory movement on the needle bed members. Selection of the needles is effected by selection units mounted at the entry of the cam tracks of the carriage, the selection units comprising inter alia electromagnets which receive electrical pulses from the selection box. The aim of this action is to move the needles into different positions so as to be actuated by different tracks of the knitting carriage, in order to produce different knitting stitches, including jacquard.

There are many processes for programming the selection of the needles of a knitting machine, in particular matrixes of stud or diode type, program card reading means of all kinds, and magnetic tape reading means, etc. The principle of such processes is always the same and comprises the provision on a carrier of the successive data which are to be transmitted to the needles, generally by electromagnetic means, in order to produce the desired knitting stitch. Such data may either be taken from the program and directly transmitted to the electromagnetic means for carrying out the selection operation, this occurring in synchronism with the forward feed movement of the carriage, or stored in a memory from which they are taken, the latter process being more burdensome for their reason. In all cases, the size of the pattern or motif which can be knitted, when the selection operation is used for producing jacquard knitting, depends on the amount of data which can be carried by the carrier.

Program cards have the advantage, as information carriers, that they give an image which is representative of the pattern to be produced, while being easy for the user to program. In order to read such cards, when an optical reading means is used, it is sufficient to provide regions in which the light is for example reflected and other regions in which the light is not reflected, which can be achieved for example by black marks, in such a way that a needle of the knitting machine corresponds to each such region.

This has obviously led manufacturers to produce checked or squared program cards, wherein each elementary square contains the piece of data relating to a given needle of the knitting machine.

In this case, the definition of the piece of data is perfect but the process does not make it possible to produce patterns whose width is that of the knitting machine, while using a program card of acceptable size, that is to say, an A4 size, or else the marks made on the cards must be so fine that programming by the operator of the machine would become a real problem by virtue of the extreme attention to minute detail which would have to be applied in carrying out the programming operation.

This limitation has led certain manufacturers of knitting machines which use a squared program card to use memories in which the data on the card are stored, then treating such data in order to produce multiplication thereof by a constant number.

This process which is already burdensome in itself suffers from two major disadvantages: firstly, the outlines of the pattern are formed by a step-like configuration whose steps are equal, at a minimum, in regard to the number of stitches and rows, to the multiplying number, and the errors and defects in the proportions of the pattern are magnified, as the process does not take account of the length of the stitches. Indeed, there is not a constant proportion between the number of rows for ten cm of knitting and the number of stitches for ten cm of the same piece of knitting; this proportion varies in dependence on the thread, the kind of stitch, the length of the stitches etc.

The aim of the present invention is to remedy these various disadvantages, and the invention seeks to provide an inexpensive solution to the problem of producing patterns which must be strictly defined, to retain the proportions of a pattern whose width is that of the bed of needles of the machine for example, in this latter case, to provide a degree of definition of the outline of the pattern which is to within a stitch, and to be easily programmable.

For this purpose, the present invention concerns a home knitting machine comprising at least one straight needle bed member provided with grooves slidably receiving the knitting needles, a carriage which is movable on the needle bed member and which is provided with selection units and cam tracks for actuating and displacing the needles of the needle bed member, a programming installation comprising reading means which are electrically connected to the selection units and which are relatively movable with respect to a program card, means for relatively displacing, from one row to the next, the reading means with respect to the program card, mechanical means for connecting the programming installation to the carriage for successive reading of the rows of the program card by the reading means in synchronism with the movement of the carriage, the machine being characterised in that the means for relatively displacing from one row to the next the reading means relative to the program card comprise means for adjusting the pitch of the scanned rows of the card.

In accordance with another feature of the invention, the connecting means for mechanically connecting the programming installation to the carriage comprise a speed selecting means.

According to another feature of the invention, the means for connecting the installation to the carriage comprise a disconnection means.

According to another feature of the invention, the programming installation comprises a plurality of sensing means for reading the program card, the sensing means being mounted at regular spacings on an endless belt.

BRIEF DESCRIPTION OF THE DRAWINGS

The invention is illustrated by way of non-limiting example in the accompanying drawings in which:

FIGS. 1 and 2 show the program cards which can be used.

DETAILED DESCRIPTION

Figure 3:
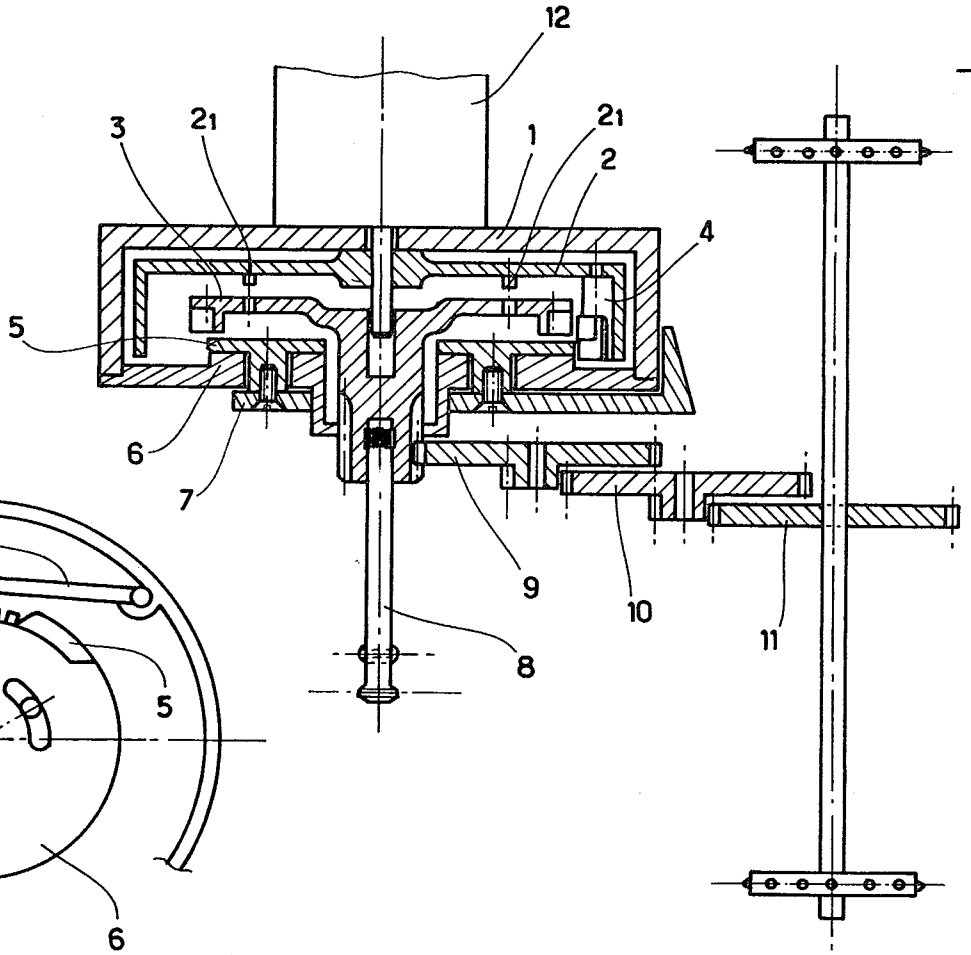
FIG. 3 shows a diagrammatic view of the means for advancing the pin wheels.

The knitting machine according to the invention associates two possibilities in a single box housing, one possibility consisting of repetitive reading of a squared program card comprising marks of contrasting colours, for example black and white, which are related to the pattern to be produced, such data being directly treated and converted for energisation or non-energisation of the coils of the electromagnets of the selection units of the knitting carriage. There is therefore no storage memory.

This first form of programming will be used for knitting patterns which are geometric or otherwise and which are repeated or not repeated, but which must be strictly defined, the size of the patterns being a fraction of the total number of needles which can normally be used, which fraction is such that it permits easy programming by the user of the knitting machine.

The second possibility consists of reading of a program card of the same format as above, but which does not have any squaring, the program being quite simply formed by an artistic design produced in contrasting colours on the program card. At the moment of selecting a certain needle, the optical reader is moved before the program card in synchronism with the knitting carriage but at a reduced speed, in such a way that the knitting carriage moves in front of all the needles of the knitting machine when the reading means, which is moved over the total working width of the program card, is interrogated in regard to its conduction state, according to whether it is disposed opposite a portion which does or does not reflect light. This information is then treated as above for energisation or non-energisation of the coil of the electromagnet of the selection unit of the carriage.

This possibility is used for producing patterns of very great width, which may be the total width of the knitting machine, while providing outlines which are in accordance with reality.

Linked with this possibility of using two program cards is the possibility of having two different types of advance movements for the program cards. When the program card is squared, the advance movement of the program card must be such that it brings a fresh row of data in front of the optical reader, for each successive row of knitting. As all the program cards have the same squared pattern thereon, a constant advance movement which is equal to the vertical pitch of the squares is both necessary and sufficient.

When the program card is not squared and therefore the program is formed by an artistic design, the advance movement of the program card must be such that the proportions of the design are observed, in the course of the knitting operation. For this purpose, the advance movement of the program card is controllable in dependence on the ratio to be observed between the number of stitches for a ten cm width and the number of rows for a ten cm height of a sample pattern of knitting produced with the same thread, the same adjustments and the same kind of stitch, as those of the article to be knitted.

FIG. 1 shows a squared program card, the pattern being illustrated by the blackened elementary squares which form the pattern. Row after row, the advance movement of the program card will bring the successive rows of squares into a position to be read by the photoelectric sensors.

FIG. 2 shows a program card which is not squared, the pattern being an artistic design. In this case, the advance movement of the program card will be such that the proportions of the pattern will be observed in the knitting operation. For this purpose, it will be necessary first of all to knit a sample pattern under the conditions in which the final article will be produced, to establish the proportion between the number of stitches and the number of rows for the same dimension, and, from this proportion, to deduce the advance movement which the program card will be required to carry out, for the successive rows of knitting.

FIG. 3 shows a diagrammatic view of the means for controlling the advance movement of the program card, row after row. The motor 12 is associated with a pulse control means and a circuit for self-supply of the motor during a revolution. The motor 12 is fixed to a casing box 1 in which there is disposed a pawl carrier 2 which is fixed with respect to the motor shaft, a ratchet wheel 3 which is capable of free rotary and translatory movement on the motor shaft, which ratchet wheel 3 meshes with pinions 9, 10 and 11 to cause rotation of the shaft on which the pin wheels for driving the program card are mounted. By means of the control shaft 8 which can be moved manually into two positions, the ratchet wheel 3 may occupy as a first axial position or upper position in which the ratchet wheel 3 is locked by direct coupling to the pawl carrier 2 by the locking fingers $2_1$. It is then fixed for rotational movement with the motor 12 and is rotated through 360°, in each control step for the advance movement of the program card. After reduction by means of the pinions 9, 10 and 11, the above-mentioned 360° rotary movement is that which must be imparted to the pin wheels in order to move the squared program card from one row of squares to another. In a second axial position or low position (shown on FIGS. 3 and 4), the ratchet wheel 3 is freely rotatable but may perform a toothwise advance movement, by means of the pawl 4 carried by the pawl carrier 2. This advance movement is determined by the use of two cams, one being a fixed cam 6 which uncovers a maximum number of teeth on the ratchet wheel 3 and the other being a movable cam 5 which is fixed with respect to a lever 7 which is manually operable, thereby making it possible to prevent the pawl 4 from acting on a selected number of teeth of the ratchet wheel, which are normally left in the operative position by the fixed cam 6. This combined action of the two cams 5 and 6 permits adjustment of the rotary movement of the ratchet wheel 3 and consequently of the pin wheels for driving the program card. This possibility is used for controlling the advance movement of the non-squared program card, and therefore the pitch of the rows, in order to knit the pattern design which is carried thereon, artistically and in the proper proportions.

Figure 4:
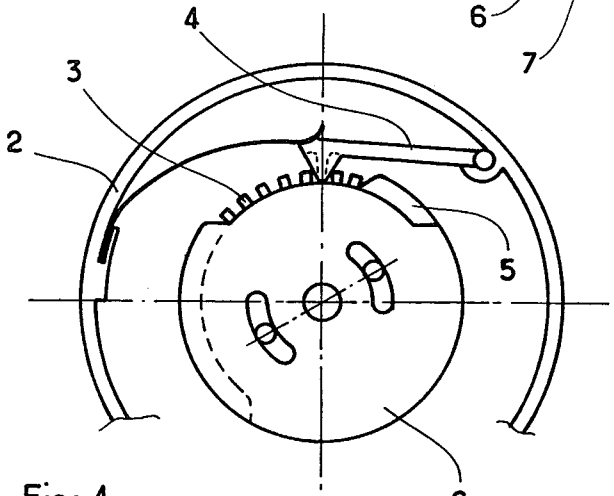
FIG. 4 shows a diagrammatic view of the drive of the ratchet wheel by the pawl.

FIG. 4 shows a detail of the control of the ratchet wheel 3 by the pawl carrier 2 on which the pawl 4 is mounted, with a spring loading. FIG. 4 also shows the manner in which the cam 6 leaves exposed a given number of teeth (seven teeth on FIG. 4) of the ratchet wheel 3, and how the movable cam 5 which rotates about the fixed cam 6 completes the action of the fixed cam 6, by preventing the pawl 4 from acting on a controllable number of teeth of the ratchet wheel 3.

Figures 5, 6, 7:
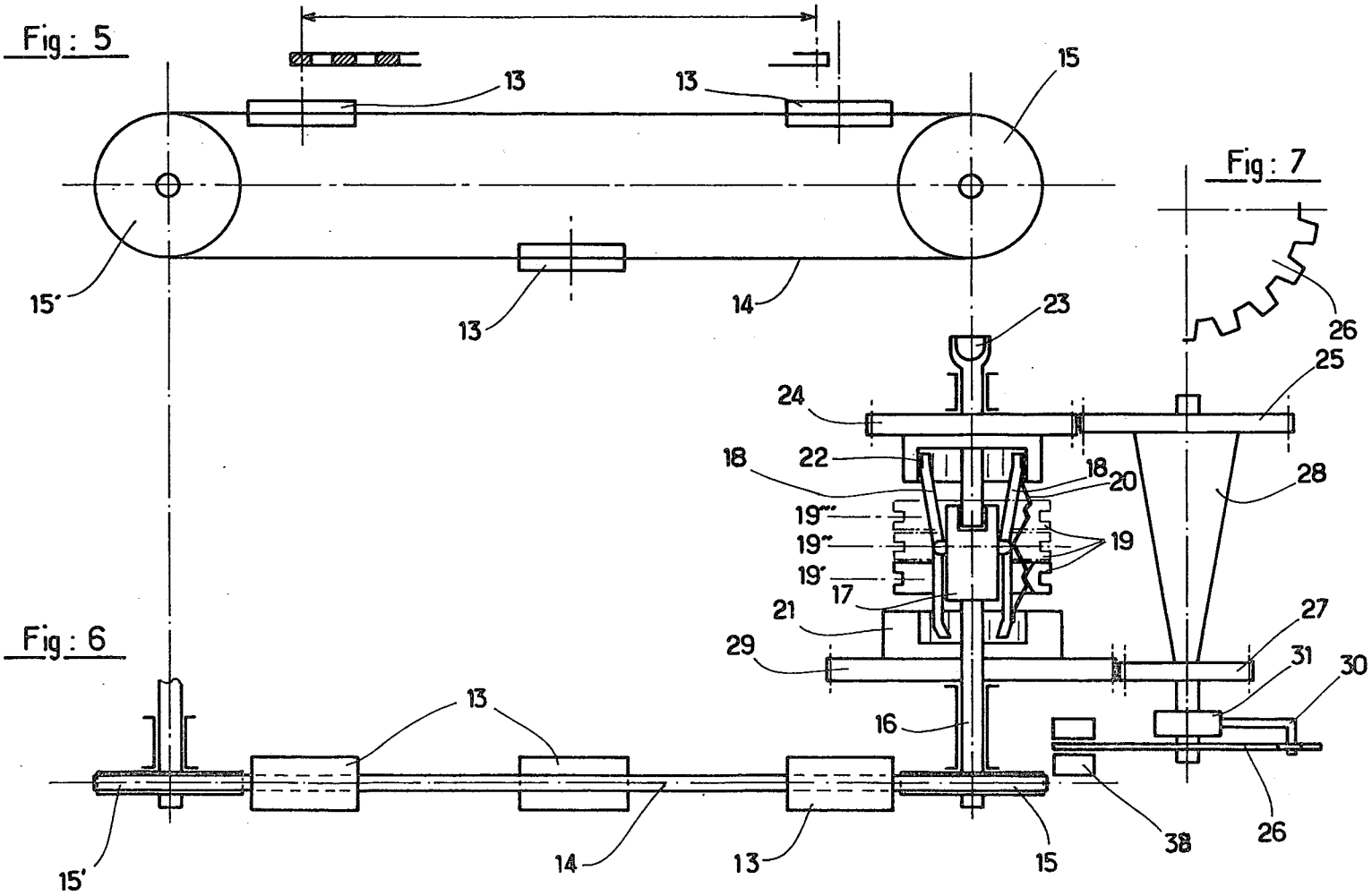
FIG. 5 shows a diagrammatic view of the mounting of the sensors on the toothed belt.
FIG. 6 is a diagrammatic view of the means for driving the sensors and the drive for the disc giving the associated design.
FIG. 7 shows a detail of the disc giving the associated design.

FIG. 5 shows the mounting of the sensors 13 at regular spacings on the toothed belt 14 which is driven in rotation by the drive pulley 15 and which passes around the idle pulley 15'. The distance between two successive sensors must be equal to the total distance between the marks on the program card 42.

FIG. 6 shows the means for driving the drive pulley 15 which drives the sensors 13 by way of the toothed belt and the idle pulley 15'. The drive pulley 15 is fixed on the shaft 16 which is itself fixed with respect to the dog clutch carrier 17. Pivotally mounted on the carrier 17 are two levers 18 comprising two arms which form between them an angle which depends on the two ratios to be provided and which are provided at each of their ends with a tooth whose shape is adapted to that of the teeth of the hollow gears into which they may engage.

A ring 19, which is slidable on the levers 18, may occupy one of three positions 19', 19'' and 19'''. In position 19', the ring 19 presses the levers 18 by way of springs 20 and forces them into engagement with the hollow pinion 22 of the wheel 24, causing the teeth to bottom against each other, to eliminate play. As the hollow pinion 22 is fixed with respect to the shaft 23, with movement being imparted to the shaft 23 by the knitting carriage, the shaft 16 is now directly fixed with respect to the shaft 23 and rotates at the same speed. This possibility is used for controlling the sensors for reading squared program cards and, when the knitting carriage is displaced by the distance between two needles, the sensors are displaced by the distance between two sucessive squares of the squared program card. As, in order to permit easy programming of the program card by the user of the machine, the number of marks carried by the program card is lower than the number of needles of a needle bed member of the knitting machine, each sensor provides for reading of the program card successively when the knitting carriage is displaced over the whole length of the needle bed of the knitting machine, until all the data required have been supplied so causing on the width of the knitting machine, the knitting of a number of pattern or motif which correspond to the number of sensors reading the program card.

In position 19''', the ring 19 presses the levers 18 by way of the springs 20 and forces them into engagement with the hollow pinion 21, the shaft 23 driving the pinion 24 which, by way of the countershaft assembly comprising the pinions 25 and 27 which are fixedly mounted on the shaft 28, drives the pinion 29 which is fixed with respect to the pinion 21 which is normally free on the shaft 16 but which is fixed with respect thereto by way of the levers 18 which are fixed with respect to the carrier 17 which is itself fixed with respect to the shaft 16. The shaft 16 is thus driven in rotation by way of the pinions 24, 25, 27 and 29. This transmission assembly makes it possible to achieve a reduction between the movement of the sensors and the movement of the carriage. This reduction is so calculated that a single sensor reads the program card when the carriage is displaced over all the needles of the knitting machine. This possibility is used for reading non-squared program cards, on which the pattern to be produced is drawn in an artistic fashion, while knitting of the pattern can be effected over the total width of the knitting machine.

If the ring 19 is in position 19'', the levers 18 do not engage with either of the pinions 21 and 22 and consequently there is no longer any rotary connection between the shaft 23 and the shaft 16. This position is the neutral position and is used for positioning the pattern. Indeed, if one of the sensors is at the beginning of the pattern on the program card when the carriage is opposite the Xth needle, it is obvious that, on moving into position 19' or 19'', the above-mentioned Xth needle will be the first needle of the pattern.

FIG. 6 also shows the means which make it possible to associate a second pattern with that of the program card. An arm 30 on a sleeve 31 is mounted on the shaft 28 and is fixed for rotation therewith. The arm 30 entrains the disc 26 which comprises tapered recesses which are disposed, for example, every two steps or pitches of the needles on the needle bed. The recesses are read by a sensor 38 in order to form a cyclically operable circuit-breaker switch which is operated synchronously with the carriage of the machine and which is incorporated in the electrical circuit connecting the reading sensors 13 and the selection units. The cyclically operable switch thus controls the selection operation at one needle in two, independently of the selection determined by the program card reading means. A circuit-breaker switch $38_1$ mounted on the circuit of the sensor 38 can render it inoperative. The arm 30 has a capacity for pivotal movement inwardly of the disc, corresponding to one pitch or step, in order thereby to produce a reversal of the selection when there is a change in the direction of translatory movement of the knitting carriage and consequently a change in the direction of rotation of the disc 26.

FIG. 7 is a front view of part of the disc 26, showing the detail of its recesses.

Figure 8:
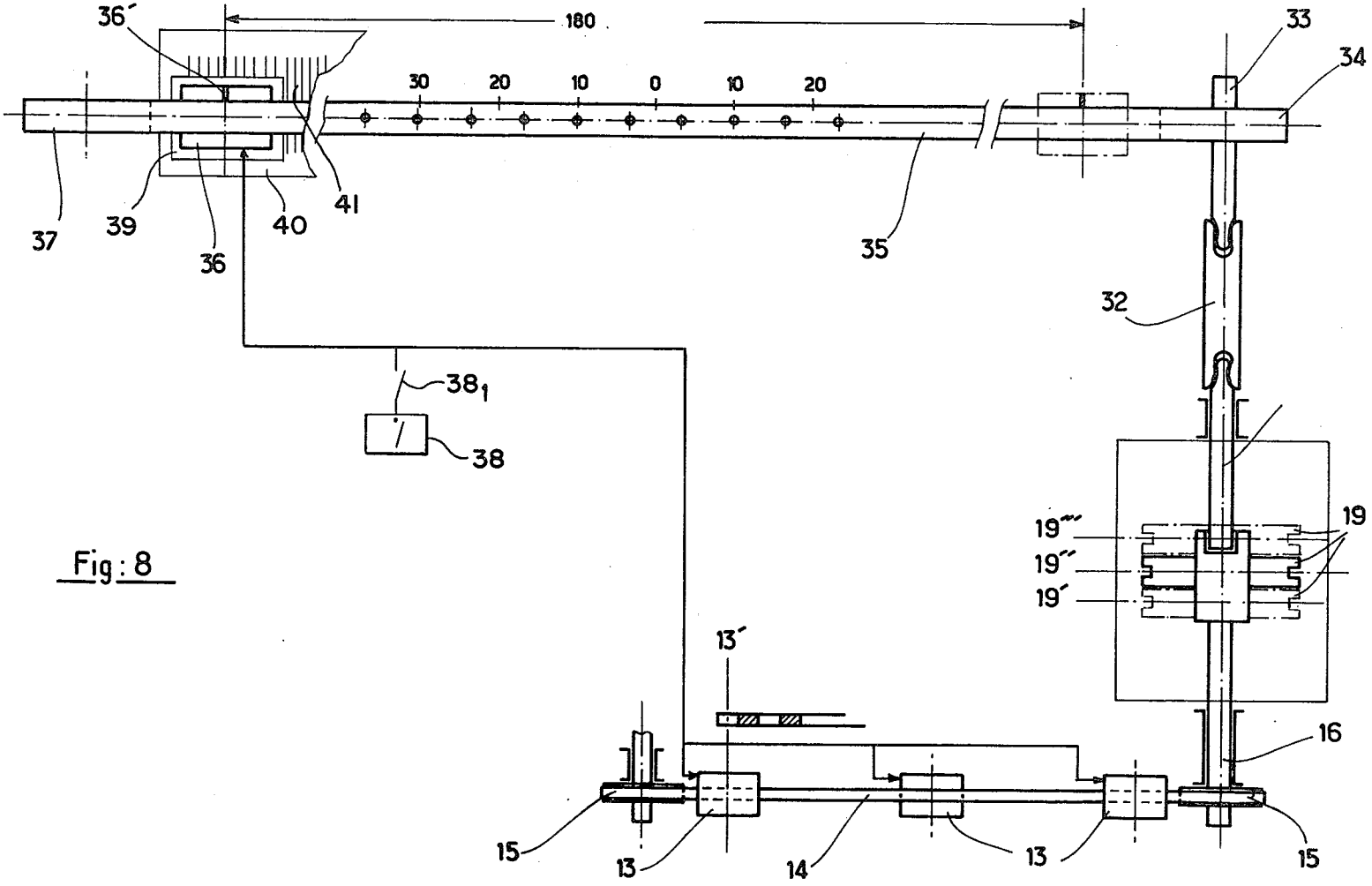
FIG. 8 is a diagrammatic view showing the connection between the drive for the sensors and the drive for the slider by the knitting carriage.

FIG. 8 is a diagrammatic view showing the connection between the slider 36 which is fixed with respect to the knitting carriage 39 in its translatory movement above the needle bed 40 of the knitting machine provided with the knitting needles 41, and the sensors 13. The slider 36 is fixed to a perforated strip 35 driving the pin wheels 37 and 34. The pin wheel 34 is non-rotatably fixed on the shaft 33 and transmits its rotary movement by way of a shaft 32 to the output shaft 23 of the selection box. When the ring 19 is in the position 19'', that is to say, its neutral position, the marker 36' on the slider 36 may be positioned opposite any needle of the knitting machine, without the sensors 13 of the box being themselves displaced. If one of the sensors 13 has its marker 13' opposite the first pattern instruction of the program card, and if the ring 19 is moved into one or other of the positions 19' and 19''', in both cases the needle opposite the marker 36' of the slider 36 will be the needle at which knitting of the pattern of the program card will be begun.

I claim:

1. A home knitting machine comprising at least one straight needle bed member, knitting needles received in said needle bed member, a carriage movable on said needle bed member for actuating and displacing the needles of said needle bed member, a programming installation comprising reading means which are electrically connected to said carriage for relative movement with respect to a program card, means for relatively displacing, from one row to the next, said reading means with respect to the program card, mechanical means for connecting said programming installation to said carriage for successive reading of the rows of the program card by said reading means in synchronism with the movement of said carriage, said machine being characterised in that said means for relatively displacing from one row to the next said reading means relative to the program card comprises means for adjusting the pitch of the scanned rows of the program card.

2. A machine according to claim 1 characterised in that the mechanical connecting means connecting the programming installation to the carriage comprise a speed selecting means.

3. A machine according to claim 2 characterised in that the means connecting the installation to the carriage comprise a disengageable clutch means.

4. A machine according to any one of the preceding claims characterised in that the programming installation comprises a plurality of sensors for reading the program card, said sensors being mounted at regular spacings on an endless belt.

5. A machine according to claim 2 characterised in that said speed selecting means comprises a speed selection box provided with a neutral position.

6. A machine according to claim 4 characterised in that the number of sensors is a divisor of the number of needles of the needle bed member of the knitting machine.

7. A machine according to claim 5 characterised in that the speed selection box comprises two speeds separated by a neutral.

8. A machine according to claim 1 characterised in that the electrical connection between the reading means and the selection units of the carriage comprises a circuit-breaker means.

9. A machine according to claim 2 characterised in that said mechanical connecting means connecting the carriage to said programming installation comprises an electrical circuit connecting said reading means to said carriage and a cyclic circuit-breaker switch and means for operating said cyclic circuit-breaker switch synchronously with the displacement of said carriage.

10. A machine according to claim 9 characterised in that said cyclic circuit-breaker switch is constructed and arranged to close the connection between said reading means and said carriage, one needle in two.

11. A machine according to claim 1 characterised in that the means for adjusting the pitch of the scanned rows of the card comprise a drive input shaft and an output shaft which is connected to the means for producing relative displacement of the reading sensors and the program card, the connection between the input shaft and the output shaft comprising a pawl-and-ratchet assembly, a fixed cam and a movable cam, the two fixed and movable cams co-operating with the pawl and being capable of determining a sector of the ratchet wheel in respect of which the pawl does not co-operate with said ratchet wheel.

12. A machine according to claim 11 characterised in that the ratchet wheel comprises means for direct coupling thereof to the motor input shaft.

13. A machine according to claim 2 characterised in that the speed selecting means comprises two toothed rings of which one is connected to the carriage and the other is connected to the means for displacing the reading means for scanning the rows of the program card, at least one elbow lever mounted pivotally in its intermediate region and co-operable by way of its ends with the rings and a ring which is movable on said lever on each side of its pivot point.

* * * * *